US006374728B1

(12) United States Patent
Baillie

(10) Patent No.: US 6,374,728 B1
(45) Date of Patent: Apr. 23, 2002

(54) BUNDLING APPARATUS FOR HOME RECYCLING OF NEWSPAPERS

(76) Inventor: Robert A. Baillie, 448-B Heather Ct., Lakehurst, NJ (US) 08733

( * ) Notice: Subject to any disclaimer, the term of this patent is extended or adjusted under 35 U.S.C. 154(b) by 32 days.

(21) Appl. No.: 09/591,943

(22) Filed: Jun. 12, 2000

(51) Int. Cl.[7] ..... B65B 13/18

(52) U.S. Cl. ..... 100/34; 100/100; 53/590; 53/592; 414/788

(58) Field of Search ..... 53/592, 590, 528; 100/34, 100; 211/50; 414/788

(56) References Cited

U.S. PATENT DOCUMENTS

| | | | | | |
|---|---|---|---|---|---|
| 2,639,037 | A | * | 5/1953 | Friend | 100/34 |
| 2,744,461 | A | * | 5/1956 | Genco | 100/34 |
| 3,382,794 | A | * | 5/1968 | Lindholm et al. | 100/34 |
| 3,459,120 | A | * | 8/1969 | Brunette | 100/34 |
| 4,154,159 | A | * | 5/1979 | Ortega | 100/34 |
| 5,042,371 | A | * | 8/1991 | Katz | 100/34 |
| 5,072,576 | A | * | 12/1991 | Evans | 100/34 |
| 5,159,875 | A | * | 11/1992 | Cohen | 100/34 |
| 5,181,460 | A | * | 1/1993 | Gremelsbacker | 100/34 |
| 5,388,506 | A | * | 2/1995 | Vargas et al. | 100/34 |
| 5,586,493 | A | * | 12/1996 | McEntee | 100/34 |
| 5,690,024 | A | * | 11/1997 | Jarund | 100/34 |

* cited by examiner

*Primary Examiner*—H. Grant Skaggs
(74) *Attorney, Agent, or Firm*—Charles I. Brodsky

(57) ABSTRACT

This invention entails the piling of newspapers to be bundled into a stack atop a pair of shelves secured to, and between, rear and side walls of a housing, with the shelves being separated a distance to allow a length of twine, cord, rope, tape or other material to be drawn down from off a roll, under and over the newspapers to be tied in perpendicular directions, without having to lift and rotate the pile. In one embodiment of the invention, the bundling apparatus can be wall-mounted, while in a second embodiment, a lower compartment can be provided to accumulate stacked bundles or to house an additional collection container for glass, plastic, metal, or paper trash so separated, as a free-standing unit.

14 Claims, 2 Drawing Sheets

FIG. 1
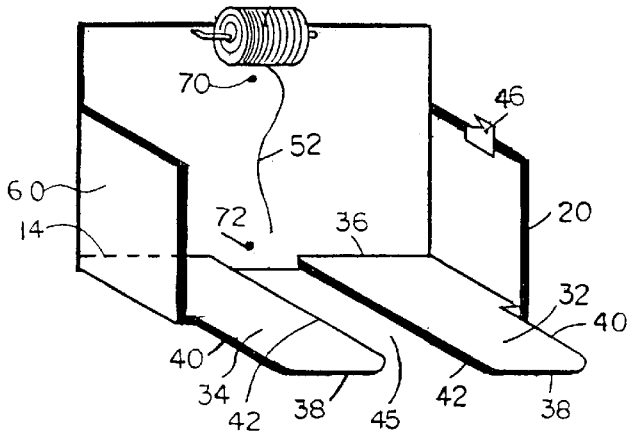
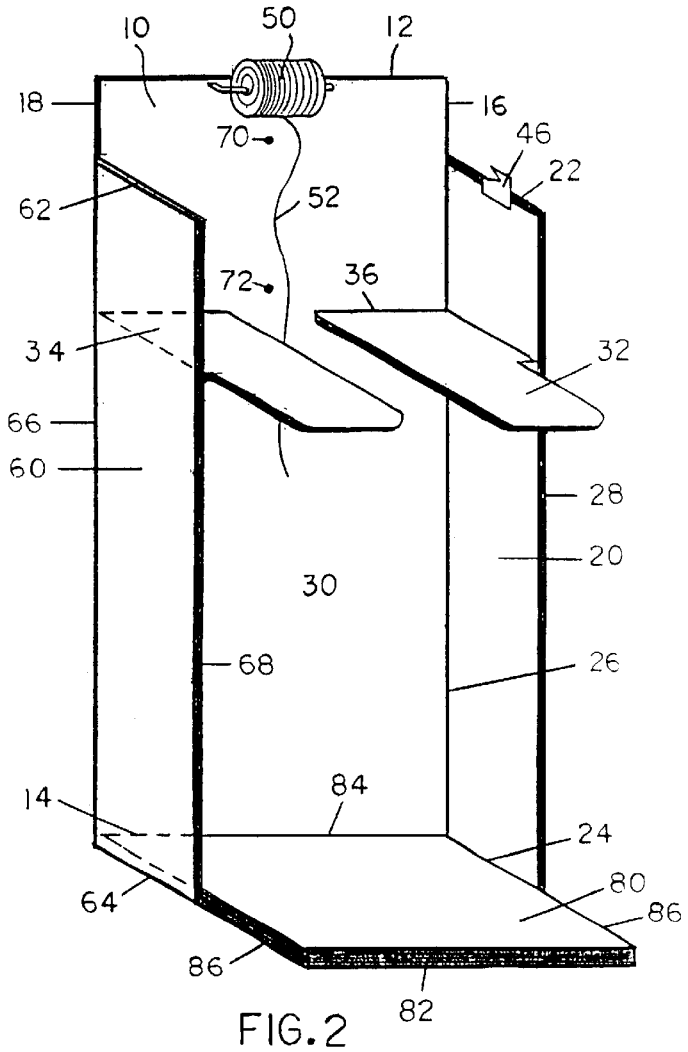
FIG. 2

BUNDLING APPARATUS FOR HOME RECYCLING OF NEWSPAPERS

FIELD OF THE INVENTION

This invention relates to the separation of trash at a home location and, more particularly, to the bundling of newspapers for recycling.

BACKGROUND OF THE INVENTION

As is well known and understood, many cities and towns across the United States presently require its residents to separate different ones of their glass, plastic, metal and paper trash for pick-up and delivery. As is also well known and understood, such requirements are also expanding internationally, and in large respects entail the separate bundling of newspapers apart from the segregated trash.

In many municipalities, moreover, these requirements further extend to the type of material used to tie the newspaper stack—distinguishing, for example, biodegradable material such as twine, cord and rope from non-biodegradable material such as cellophane or shrink-wrap tape. Although magazines are oftentimes prohibited by certain communities from being tied with newspapers, other communities permit the joining of them for purposes of collection—with some even holding that any insert which is interleaved with a newspaper as delivered may be tied with it when being bundled by the homeowner.

As is often the situation, newspaper pick-up for recycling—or conversely, their individual delivery to a central pick-up location—occurs weekly or every other week. Typically, during the intervening period, the apartment dweller or homeowner allows the newspapers to accumulate. This may be done by collecting them in a cardboard carton or in a wooden crate, or by just stacking them in a garage or laundry room. When it becomes time to bring the newspapers out for curb-side pick-up or to deliver them to a central dumpster, for example, the resident then is faced with the task of tying and bundling the accumulation, frequently by getting down on the hands and knees so to do. As will be appreciated, this becomes quite cumbersome, and uncomfortable to accomplish. At the same time, the accumulation may be such that the bundled pile just stacks too high to be easily picked up for carrying by the resident or by the sanitation worker at the curb. In fact, many communities restrict the height to which the stack can be tied as a safety measure for their workers to lift—adding yet another inconvenience to the apartment dweller or homeowner in having to break the stack into smaller ones, to be re-bundled and re-tied for removal.

In any event, although these problems and inconveniences continue to persist, the trend is definitely present to increase the separation of the different types of one's trash, and to bundle newspapers for recycling.

OBJECTS OF THE INVENTION

It is an object of the invention, therefore, to provide a bundling apparatus for the home recycling of newspapers which overcomes much of the inconveniences associated with their tying.

It is another object of the invention to provide such bundling apparatus of a type which can be used either by an apartment dweller or by a homeowner, alike.

It is also an object of the invention to provide such newspaper bundling apparatus in a manner to sell at retail at a price that a user would be willing to pay for it.

It is yet a further object of the invention to provide such bundling apparatus of a construction to allow complete use both by men and women alike, and of no unusual strength characteristic.

SUMMARY OF THE INVENTION

As will become clear from the following description, the bundling apparatus of the present invention may be fabricated as a 1-piece mold, plastic parts and other materials as desired, and equipped with a handle and wheels to enable it to be brought to the curb-side in those locations where municipal or private pick-up is available. As will also be seen, one feature of its construction allows not only for the bundling of newspapers for recycling, but for the accumulation of glass, plastic, metal or paper trash through the separate usage of a pail or similar container housed at its base.

In particular, a preferred embodiment of the invention includes a rear wall having front and back surfaces, a top edge, a bottom edge, and a pair of side edges. A first side wall is incorporated having a top edge, a bottom edge, and a pair of side edges extending forwardly from the front surface of the rear wall, with one of the pair of side edges of the first side wall being coupled with one of the pair of side edges of the rear wall. First and second shelves are included, each having its own rear edge coupled with the front surface of the rear wall below its top edge, a forward edge, and a pair of side edges—with one edge of one of the two shelves being coupled with the first side wall, and with the other edge of that shelf being spaced apart from a facing edge of the other shelf to form a slot between the two shelves. A source (e.g. a roll) of twine, cord, rope, tape, etc. is added, secured at the front surface of the rear wall between its top edge and the two shelves, particularly at a location substantially overlying the slot between the shelves. In accordance with the invention, a cutting edge is provided on the first side wall for slicing the twine, cord, etc. from the roll at a desired length. As described below, the two shelves of the apparatus are of a composition to support the weight of newspapers placed on them for tying, with the cutting edge being situated to slice the twine, etc. once the newspapers are bundled.

In a preferred embodiment of the construction, the first and second shelves are positioned a distance some 13 inches below the top edge of the rear wall, in establishing the height of the newspapers being bundled. In this arrangement, means may be provided in the rear wall of the bundling apparatus to permit the hanging of the apparatus, such as on an inside garage wall.

On the other hand, in a second embodiment to be described, the rear wall of the bundling apparatus may be selected of a length to allow the incorporation of a base beneath the shelves (a distance of some 26 inches away, for example), to allow for the stacking on the base of the individual piles of newspapers tied, or alternatively to allow for the support of a pail or basket, or other container for that matter, to alternatively collect the glass, plastic, metal or paper trash separations. In this arrangement, the apparatus may be essentially free-standing.

By providing a handle and a set of wheels on the back surface of the rear wall of this second version, the apparatus becomes something which can be easily manipulated in bringing down to a curb-side for pick-up—and, either by a man or woman, of average size.

BRIEF DESCRIPTION OF THE DRAWINGS

These and other features of the present invention will be more clearly understood from a consideration of the following description, taken in connection with the accompanying drawings, in which:

FIG. 1 is a front perspective view of bundling apparatus for the home recycling of newspapers according to the invention, particularly suitable for wall mounting;

FIG. 2 is a front perspective view of the bundling apparatus of the invention as it might appear for seating upon a floor;

Figure 3:
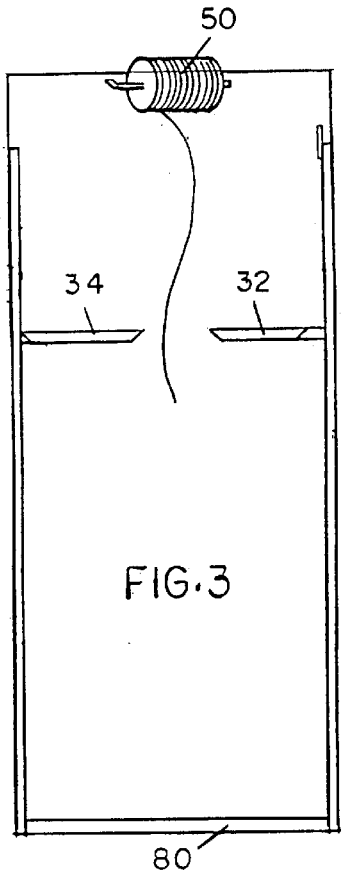
FIGS. 3 and 4 are front and side views, respectively, of the bundling apparatus of FIG. 2.

DETAILED DESCRIPTION OF THE INVENTION (While the teachings of the present invention will be understood to apply to any material available to tie newspapers—such as twine, cord, rope, tape, etc.—, the following description specifically calls out the material as being a biodegradable twine for purposes of simplicity. Similarly, while the "base" of the apparatus to be described may serve as a resting place for a pail, bucket or other container in which glass, plastic, metal or paper trash can be temporarily held and collected, the following description proceeds on the proposition that individual stacks of newspapers bundled to a pre-selected height are to be placed there one atop the other for later collection. In the description that follows, it will also be appreciated that the composition of the shelves to be described is selected to support the weight of newspapers to be placed thereon to a height of substantially 12 inches—well within the restrictions placed by some cities and municipalities as to the size of stacks to be then handled by their workers in removal.)

Thus, referring to the drawings, the bundling apparatus of the invention includes a rear wall 10, having a top edge 12, a bottom edge 14 and a pair of side edges 16, 18. A first side wall 20 is included, also having a top edge 22, a bottom edge 24 and a pair of side edges 26, 28 extending forwardly from a front surface 30 of the rear wall 10, and with one of the pair of side edges 26 being coupled with one of the pair of side edges of the rear wall 16.

First and second shelves 32, 34 are included, with each having a rear edge 36 coupled with the front surface 30 of the rear wall 10, a forward edge 38 and a pair of side edges 40, 42. As indicated, one edge of the pair 40 is coupled with the first side wall 20, with its other edge 42 being spaced apart from a facing edge 42 of the other shelf 34 in forming a slot 45 between them. A roll of preferably biodegradable twine 50 is secured at the front surface 30 of the rear wall 10 between its top edge 12 and the two shelves 32, 34 at a location substantially overlying the slot 45 so as to allow twine 52 to be drawn off the roll 50 into the slot area. A cutting edge 46 completes the construction, located on the first side wall 20—along its top edge 22, for example—to slice the twine 52 at a desired length.

As the bundling apparatus of the invention operates to allow a pile of newspapers to be placed upon the shelves 32, 34, and to permit the draw-down of twine 52 from off the roll 50 behind the pile of newspapers in wrapping and tying them before slicing the twine at the cutting edge 46, the composition of the shelves 32, 34 is selected according to the invention to support the weight of the newspapers there placed.

In operation of the invention, the pile of newspapers are placed atop the shelves 32, 34 and squared against the side wall 20, in then permitting the twine 52 to be drawn from the roll 50, down behind the pile and around its bottom between the shelves 32, 34, and back over the front of the newspapers. The twine 52 is then tied to itself at the top/center of the pile without cutting the twine 52 from the roll 50, thereby wrapping the pile in one direction. To complete the bundling, the twine 52 is then drawn at a right angle around one of the sides of the pile, under the shelves 32, 34, and back over the opposite side of the pile before slicing the twine 52 on the cutting edge 46. In particular, the twine 52 is cut to leave a sufficient length to be tied off at the intersection of the first wrapping. The stack is then simply slid forward, off the shelves 32, 34, and the bundling is complete, all without any need of having to lift the pile to rotate it at right angles for tying the second time.

As many cities and towns have imposed restrictions as to the height of the newspaper stack so formed to be of the order of some 12 inches, the composition selected for the shelves 32, 34 is such as to support this weight. In addressing this, further, the shelves 32, 34—in a preferred embodiment of the invention—are situated some 13 inches or so below the top edge 12 of the rear wall 10. As shown in FIGS. 1, 2, 4 and 5, the shelves 32, 34 extend forwardly from the front surface 30 of the rear wall 10 a distance greater than the forward extension of the side wall 20 from the front surface 30. In this embodiment, the shelves 32, 34 may extend forwardly from the front surface 30 a distance of 11 inches, while the side wall 20 may extend forwardly a distance of 6 inches. The shelves 32, 34 are further shown in FIG. 3 with their bottom edges angled, to ease the sliding of the twine 52 around the newspaper pile.

Figure 4:
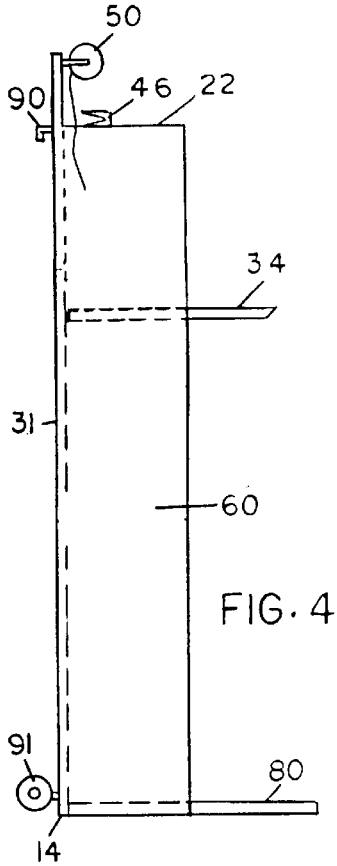
Figure 5:
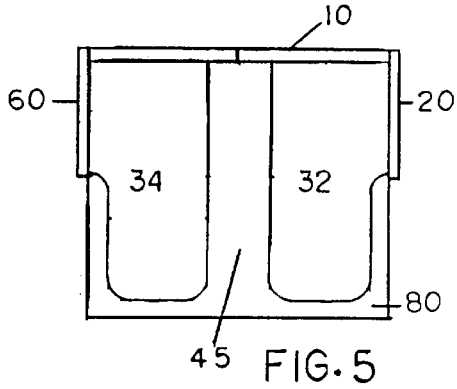
FIG. 5 is a top view helpful in an understanding of certain dimensions of the components of FIG. 2.

With the shelves 32, 34 oriented colinearly along the front surface 30 as shown in FIGS. 1–4, and with the cutting edge 46 shown positioned adjacent the top edge 22 of the side wall 20, a further embodiment of the invention may include a second side wall 60 extending forwardly from the rear wall 10, so as to allow the squaring of a pile of newspapers to be bundled at each of its sides. This may be attained by selecting the width of the rear wall 10 measured from left-to-right to be of the order of 16 inches, with the shelves 32, 34 being themselves 6 inches wide each, separated by a slot 45 of 4 inches. As with the side wall 20, the second side wall 60 includes a top edge 62, a bottom edge 64 and a pair of side edges 66, 68, with the side edge 66 being coupled with the other side edge 18 of the rear wall 30. As with the arrangement of the first shelf 32, the side edge 40 of the shelf 34 is joined with this second side wall 60, as more clearly shown in FIGS. 1, 2 and 3. For purposes of conformity and ease of manufacture, the two shelves 32, 34 and the two side walls 20, 60 may be selected of comparable dimension—and, while the cutting edge 46 is shown as secured to the side wall 20, such cutting edge may, instead, be placed along the top edge 62 of the side wall 60, or may be placed atop both side walls, if desired. As FIG. 5 illustrates, both shelves 32, 34 continue to extend forwardly from the front surface 30 of the rear wall 10 a distance greater than the forward extension of either, or both, of the side walls 20, 60.

FIGS. 1 and 2 show alternative arrangements for the invention—with that of FIG. 1 being primarily intended for "wall-mounting", and with that of FIG. 2 being intended for free-stand resting on the floor. With the configuration of FIG. 1, the shelves 32, 34 are illustrated as being coupled with the bottom edge 14 of the rear wall 10. A pair of apertures 70, 72, are included for receiving screws, bolts, nails or similar such fasteners for holding the bundling apparatus of FIG. 1 to a wall for hanging in any appropriate manner. In its use, the newspapers to be bundled are placed upon the shelves 32, 34, are then tied and wrapped with the twine 52—and after the twine is sliced off at the cutting edge 46, is typically placed on an adjacent floor location awaiting carrying down to the curb-side for pick-up or delivery to a central dumpster or like depository. In this version of FIG. 1, the distance between the apertures 70, 72 may be of the order of 10 inches.

In the alternative arrangement of FIG. 2, on the other hand, a base 80 is provided having a forward edge 82, a rear edge 84 and a pair of side edges 86 extending forwardly from the front surface 30 of the rear wall 10. As shown, the rear edge 84 is coupled with the bottom edge 14 of the rear wall 10, and the side edges 86 are respectively coupled with the bottom edges 24, 64 of the side walls 20, 60. In accordance with this alternative construction, the two shelves 32, 34 are placed closer to the top edge 12 of the rear wall 10 then they are placed to the bottom edge 14 of the rear wall, thereby leaving an open, lower compartment between the shelves 32, 34 and the base 80. As will be understood, this base 80 allows for the storage of individual stacks of newspapers previously bundled until time for pick-up; or, the space between the shelves 32, 34 and the base 80 might be used for the placement of a collection container atop the base to receive glass, plastic, metal, or paper refuse to be collected according to the trash separation requirements of the municipality or community. Although not then generally intended for wall mounting, but rather for floor standing, the arrangement of FIG. 2 could still continue to be wall mounted, through the inclusion of the apertures 70, 72. In order to accommodate the dimensions of a usually larger collection container, the base 80 may be selected to extend forwardly from the rear wall 10 even a greater distance than the shelves 32, 34, as shown in FIGS. 4 and 5. In one embodiment of this arrangement of the invention, the shelves 32, 34 extend forwardly a distance of 11 inches, while the base 80 extends forwardly from the rear wall 10 a distance of 13 inches. The distance between the shelves 32, 34, on the one hand, and the base 80, on the other hand, could be of the order of 26 inches, measured vertically.

Yet, a further embodiment of the invention may be had where it is desired to allow for the bundling apparatus of the invention to be taken as an entire unit directly to a curb-side location for newspaper pick-up, instead of a resident having to lift the accumulated newspaper stacks individually, in carrying them down for pick-up. Such an embodiment is also illustrated in FIG. 4, by the inclusion of a handle 90 at the back surface 31 of the rear wall 10, adjacent its top edge 12, together with a pair of wheels 91 on the back surface 31 adjacent the bottom edge 14. A user then simply tilts the bundling apparatus rearwardly, grasping the handle 90 and wheeling the entire apparatus directly to the curb-side for pick-up.

While there have been described what are considered to be preferred embodiments of the present invention, it will be readily appreciated by those skilled in the art that modifications can be made without departing from the scope of the teachings herein. Thus, whereas the drawings presently illustrate the roll of twine 50 as being secured to the rear wall 10 in a manner similar to that by which a toilet paper roll is commonly held in place, any appropriate manner of securement is acceptable, provided the twine 52 can be withdrawn behind the piled newspapers, down, around and over them through the slot 45 between the two shelves 32, 34. Similarly, while the component parts of the rear wall 10, the side walls 20, 60, the shelves 32, 34 and/or the base 80 can all be held together by individual screws, bolts, nuts, etc. or similar fasteners, an alternative way of holding them all together could be attained through a molding operation, providing those parts as a single unit in a 1-piece fabrication. Likewise, any manner can be employed to hold the cutting edge 46 in place, whether it be to either or both side walls 20, 60, to the rear wall 10, or otherwise, and whether as part of a molded construction, or as an add-on to the finished wall fabrication. And, while a particularly attractive arrangement of the invention has been put together of ½ inch thick polyethylene plastic for its component parts, other materials can be envisioned for use, and still be attractive for retail sale at between $29.95 and $34.95, for example. All this is believed to be within the purview of one skilled in the art—allowing a bundling of the newspaper pile without having to pick it up and rotate it 90° to tie it the second time—and, for at least such reason, therefore, resort should be had to the claims appended hereto for a true understanding of the scope of the invention.

I claim:

1. Bundling apparatus for home recycling of newspapers comprising:

a rear wall having front and back surfaces, a top edge, a bottom edge, and a pair of side edges;

a first side wall having a top edge, a bottom edge, and a pair of side edges extending forwardly from said front surface of said rear wall, with one of said pair of side edges of said first side wall being coupled with one of said pair of side edges of said rear wall;

first and second shelves extending forwardly from said front surface of said rear wall, each having a rear edge coupled with said front surface, a forward edge, and a pair of side edges, with one edge of one of said first and second shelves being coupled with said first side wall, and with the other edge of said one of said first and second shelves being spaced apart from a facing edge of the other of said first and second shelves forming a slot therebetween;

a roll of newspaper bundling material selected of the group of twine, cord, rope and tape secured at said front surface of said rear wall between said top edge thereof and said first and second shelves at a location thereon substantially overlying said slot;

and a cutting edge on said first side wall for slicing said material from said roll at a desired length;

with said first and second shelves being of a composition to support the weight of newspapers placed thereon for tying with said material;

a second side wall having a top edge, a bottom edge and a pair of side edges, also extending forwardly from said front surface of said rear wall, with one of said pair of side edges of said second side wall being coupled with the other of said pair of side edges of said rear wall; and wherein said rear edges of said first and second shelves are coupled with said bottom edge of said rear wall.

2. The apparatus of claim 1 wherein said first and second shelves are of a composition to support the weight of newspapers placed thereon to a height of at least 12 inches.

3. The apparatus of claim 1 wherein said first and second shelves are coupled with said front surface of said rear wall substantially colinearly therealong.

4. The apparatus of claim 1 wherein said cutting edge on said first side wall is positioned adjacent the top edge thereof.

5. The apparatus of claim 1 wherein said first and second shelves extend forwardly from said front surface of said rear wall a distance greater than the forward extension of said first and second side walls from said front surface of said rear wall.

6. The apparatus of claim 1, additionally including means on said front surface of said rear wall for the hanging of said apparatus when in use.

7. Bundling apparatus for home recycling of newspapers comprising:

a rear wall having front and back surfaces, a top edge, a bottom edge, and a pair of side edges;

a first side wall having a top edge, a bottom edge, and a pair of side edges extending forwardly from said front surface of said rear wall, with one of said pair of side edges of said first side wall being coupled with one of said pair of side edges of said rear wall;

first and second shelves extending forwardly from said front surface of said rear wall, each having a rear edge coupled with said front surface, a forward edge, and a pair of side edges, with one edge of one of said first and second shelves being coupled with said first side wall, and with the other edge of said one of said first and second shelves being spaced apart from a facing edge of the other of said first and second shelves forming a slot therebetween;

a roll of newspaper bundling material selected of the group of twine, cord, rope and tape secured at said front surface of said rear wall between said top edge thereof and said first and second shelves at a location thereon substantially overlying said slot;

and a cutting edge on said first side wall for slicing said material from said roll at a desired length;

with said first and second shelves being of a composition to support the weight of newspapers placed thereon for lying with said material;

a second side wall having a top edge, a bottom edge and a pair of side edges, also extending forwardly from said front surface of said rear wall, with one of said pair of side edges of said second side wall being coupled with the other of said pair of side edges of said rear wall; and wherein said rear edges of said first and second shelves are coupled with said front surface of said rear wall at a location closer to said top edge of said rear wall than to said bottom edge of said rear wall;

also including a base having a forward edge, a rear edge and a pair of side edges extending forwardly from said front surface of said rear wall, with the rear edge of said base being coupled with said bottom edge of said rear wall, and with each of said pair of side edges of said base being respectively coupled with said bottom edge of said first and second side walls; and wherein said base extends forwardly from said front surface of said rear wall a distance greater than the forward extension of said first and second side walls from said front surface of said rear wall.

8. The apparatus of claim 7 wherein said base extends forwardly from said front surface of said rear wall a distance greater than the forward extension of said first and second shelves from said front surface of said rear wall.

9. The apparatus of claim 8 wherein said rear wall, said first and second side walls, said first and second shelves and said base are fabricated as a 1-piece mold.

10. The apparatus of claim 7 wherein said first and second shelves extend forwardly from said front surface of said rear wall at a point substantially 13 inches below said top edge of said rear wall.

11. The apparatus of claim 10 wherein said base extends forwardly from said front surface of said rear wall at a point substantially 26 inches below said first and second shelves.

12. The apparatus of claim 10 wherein said first and second shelves extend forwardly from said front surface of said rear wall a distance of substantially 11 inches.

13. The apparatus of claim 10 wherein said base extends forwardly from said front surface of said rear wall a distance of substantially 13 inches.

14. The apparatus of claim 7, also including a handle on said back surface of said rear wall adjacent the top edge thereof, and a pair of wheels on said back surface adjacent the bottom edge thereof.

* * * * *